US008574020B2

(12) United States Patent
Smith

(10) Patent No.: US 8,574,020 B2
(45) Date of Patent: Nov. 5, 2013

(54) ANIMATED INTERACTIVE FIGURE AND SYSTEM

(76) Inventor: Gary W. Smith, San Diego, CA (US)

( * ) Notice: Subject to any disclaimer, the term of this patent is extended or adjusted under 35 U.S.C. 154(b) by 224 days.

(21) Appl. No.: 12/924,524

(22) Filed: Sep. 28, 2010

(65) Prior Publication Data

US 2011/0076913 A1 Mar. 31, 2011

Related U.S. Application Data

(60) Provisional application No. 61/277,854, filed on Sep. 29, 2009.

(51) Int. Cl.
*A63H 3/00* (2006.01)

(52) U.S. Cl.
USPC ..... 446/268; 446/484

(58) Field of Classification Search
USPC ..... 446/268
See application file for complete search history.

(56) References Cited

U.S. PATENT DOCUMENTS

| | | | | |
|---|---|---|---|---|
| 5,191,615 | A * | 3/1993 | Aldava et al. | 381/2 |
| 5,733,131 | A * | 3/1998 | Park | 434/307 R |
| 6,268,849 | B1 * | 7/2001 | Boyer et al. | 725/40 |
| 6,452,348 | B1 * | 9/2002 | Toyoda | 318/3 |
| 6,629,133 | B1 * | 9/2003 | Philyaw et al. | 709/217 |
| 6,684,127 | B2 * | 1/2004 | Fujita et al. | 700/245 |
| 6,773,344 | B1 * | 8/2004 | Gabai et al. | 463/1 |
| 2002/0133818 | A1 * | 9/2002 | Rottger | 725/37 |
| 2004/0043816 | A1 * | 3/2004 | Gilton | 463/39 |
| 2005/0148279 | A1 * | 7/2005 | Maa | 446/297 |

FOREIGN PATENT DOCUMENTS

| | | | |
|---|---|---|---|
| EP | 1324611 | A2 * | 7/2003 |
| WO | WO 9639236 | A1 * | 12/1996 |

* cited by examiner

*Primary Examiner* — Tramar Harper
(74) *Attorney, Agent, or Firm* — Continuum Law; Robert P. Cogan

(57) ABSTRACT

A system and subsystems include a server for determining the identity of a media program being received which will provide stimuli to an interactive figure. The system, and the subsystem as well as programmed media which, when executed on a processor, will operate the interactive figure, the system, and subsystems. A master library of sound patterns, preferably housed in a server, provides a reference for a recognition routine to identify, e.g., a particular television show. A control signal library stores commands each corresponding to a distinctive value. The commands initiate actions, e.g., motion, speech, or other response, by operating means in the interactive figure. The server may "push," or transmit information to a user computer which transmits to and which may receive intelligence from the interactive figure.

3 Claims, 5 Drawing Sheets

ANIMATED INTERACTIVE FIGURE AND SYSTEM

CROSS REFERENCE TO RELATED APPLICATIONS

This patent application claims priority of Provisional Patent Application 61/277,854, filed Sep. 29, 2009.

BACKGROUND OF THE INVENTION

1. Field of the Invention

The present subject matter relates to an interactive figure, which may be a toy, which responds to transmitted intelligence and to a system, subsystems, method, and programmed media in which a program bearing the intelligence is predicted.

2. Background

Interactive figures have been provided that will react to various stimuli. These may include sounds from a medium or from a user. However, the stimuli are generally selected in real-time. There is no preprogrammed set of user media preferences. Systems including such interactive figures generally have a single library of available responses. The system does not prepare itself for interaction with a particular scheduled program.

SUMMARY

Briefly stated, in accordance with the present subject matter, there are provided an interactive figure, a system and subsystems for predicting the occurrence of a program with which a user desires a figure to interact, a system and subsystems providing libraries to define possible actions of the interactive figure and command a currently indicated action, methods for operating the figure, the system, and the subsystem as well as programmed media which, when executed on a processor, will operate the figure, the system, and subsystems in accordance with the present subject matter.

A master library of sound patterns is created to provide a reference for a recognition routine. A selected media program, e.g., a particular television show, provides an audio input which is transformed by a function, e.g., a hidden Markov model, to provide sound patterns each indicative of a sound unit. The sound unit may comprise a phoneme, word, or concatenated sequence. Real-time signals are compared to the library by a recognition module using a recognition method. Outputs from the recognition module, each having a distinctive value corresponding to recognition of a respective sound unit, are used to command action of the interactive figure in accordance with the sound unit. A control signal library stores commands each corresponding to a distinctive value. The output of the recognition module may be used to address the control signal library.

A server library may be located in a server remote from the user location. The server library may also comprise a search engine and result processor to compile a library of programming schedules including the name of a program, day and time occurrence, and identity of the carrier.

The user location is coupled to the server via network, e.g., the Internet. Periodically, the server may "push," or transmit information to a user computer. The information may comprise a set of sound patterns and a program schedule for populating local libraries. The user location will be prepared to respond to a media source which corresponds to the current sound pattern library. A recognition module provides signals to select a command from a command library for transmission to the interactive figure.

The interactive figure receives inputs from the media source. Generally these inputs comprise analog sounds. The interactive figure comprises a control circuit and operating components, e.g., motors and linkages to operate the interactive circuit in accordance with commands.

The interactive figure and the user computer exchange information. One form of communications link is a radio frequency link between a transceiver at the user location computer and a transceiver in the interactive figure. The interactive figure transmits signals indicative of stimuli to the user computer. The user computer transmits signals indicative of figure control signals to the interactive figure.

There figures are also illustrative of architecture and programmed media for software employed in the system and subsystems of the present subject matter and of methods.

DETAILED DESCRIPTION

The present subject matter comprises a system for predicting a program to which a toy will respond synchronously with a program. The present subject matter further comprises a system, subsystems, methods for operating a system and subsystems, as well as programmed media which, when executed on a processor, operate the interactive figure, system, and subsystems.

Figure 1:
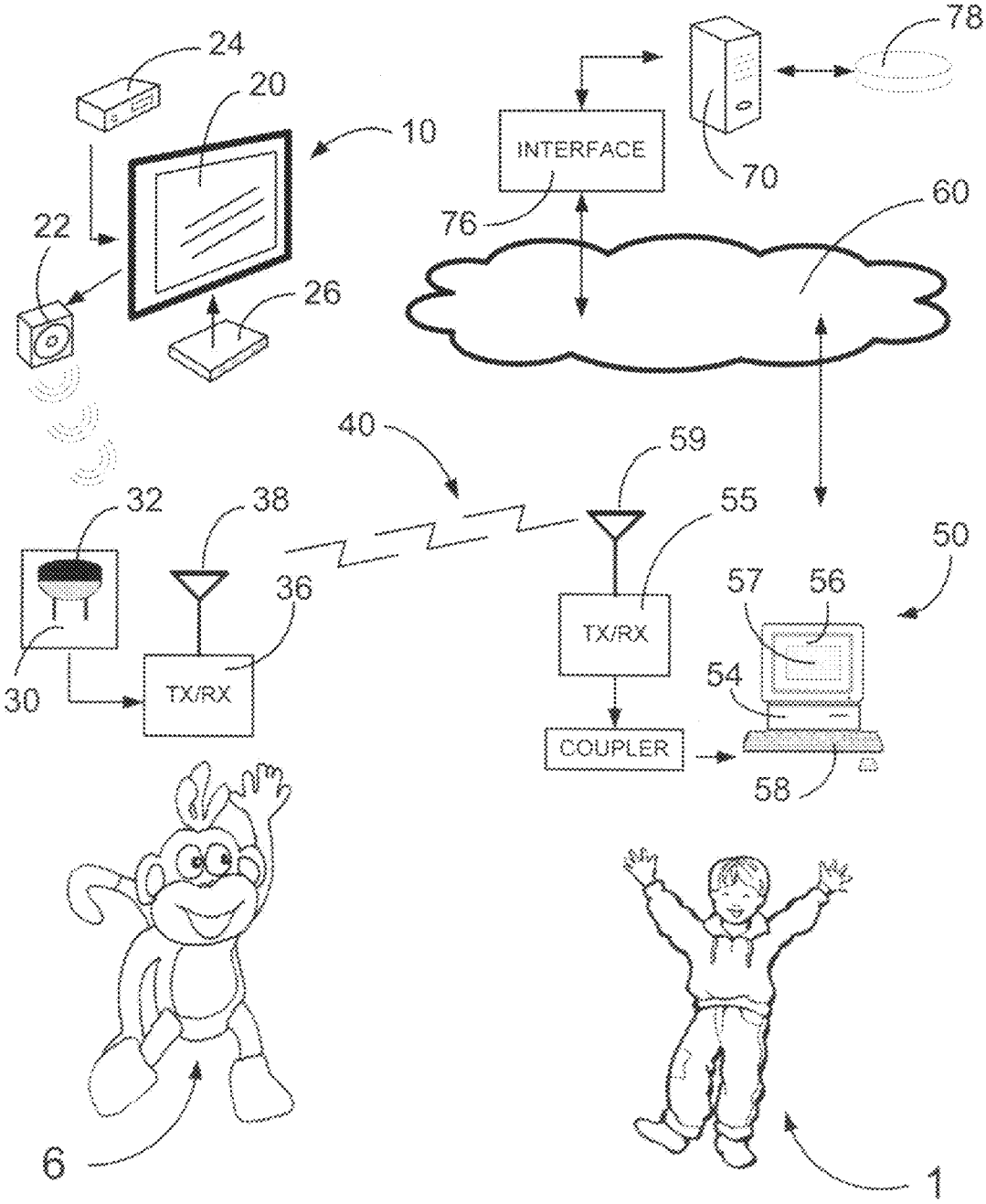
FIG. 1 is an illustration of a system incorporating the present subject matter.

A brief overview is provided in connection with FIG. 1, which is an illustration of a system incorporating the present subject matter. A user in the form of a child 1 will interact with an interactive toy 6. The interactive toy 6 will interact with a program of interest to the child 1. The user could be any individual, or a plurality of individuals. A child 1 is selected in the present illustration, but is only one form of representative user. In the present embodiment, the toy 6 is shown as a plush toy. It could be virtually any object of interest to a particular type of user. The toy 6 could comprise an effigy of a sports figure or an entertainer, for example. Alternatively, the toy 6 could be a non-anthropomorphic representation of a vehicle or other object.

As further described below, the toy 6 may, for example, perform actions synchronized with a program in a particular medium. The child 1 may view the toy 6 as being an object that is autonomously operating in concert with the program. In many applications, the medium will be television, whether from a current or recorded television program. The toy 6 will be capable of resolving the identity of a currently playing program and selected content within the program.

The toy 6 responds to signal inputs from a media source 10. The media source, in many embodiments, will comprise a television receiver 20 emitting sound from a speaker 22. The television receiver 20 may receive signals from sources such as a cable box 24 or a media player 26, which could be a DVD player. In typical embodiments, the source 10 will provide sounds from an analog audio source. The sounds act as a stimulus to the toy 6. However, the toy 6 could be provided with transducers to provide stimuli other than sound from an alternative media source 10, for example, infrared signals.

The toy 6 uses a transducer 30 to respond to signals from the media source 10. In the present illustration, the transducer 30 comprises a microphone 32. The microphone 32 provides a signal that will be analyzed to produce responses in the toy 6. The microphone 32 will respond to sounds, for example, audio outputs of the media source 10. The range from the media source 10 at which the toy 6 will be able to respond to sounds is a function of the sensitivity of the microphone 32 and volume supplied by the media source 10.

The microphone 32 is coupled to an interactive figure transceiver 36 having an antenna 38. The interactive figure transceiver 36 provides a link 40 between the toy 6 and a user location 50. Generally, the link 40 is a radio frequency link. However, use of radio frequency is not essential.

The user location 50 is generally conveniently embodied in a user computer 54, which may have a monitor 56, which may display a graphical user database (GUI) 57 and a keyboard 58. The radio frequency link 40 is coupled to the user computer 54 by a coupler 55 having an antenna 59. One form of coupler 55 is an RF card comprising a user location transceiver 52 and plugging into a computer slot. The coupler 55 may connect to the user computer 54 through a USB dongle 57 in order to control access of RF signals to the user computer 54. The user location 50 is described in greater detail with respect to FIG. 3 below. The user location 50 interacts with a host server 70 which acts as a host. Many different networks may provide interconnectivity. Most commonly, the Internet 60 will be used.

The host server 70 is briefly described with respect to FIG. 1, and is described in further detail with respect to FIG. 4 below. The host server 70 comprises an interface 76 which addresses a system memory 78. The system memory 78 includes a number of databases. These databases, described further with respect to FIG. 4 below, may include a sound library, a master sound and motion interactivity file, relevant television program schedules, and other data which can be "pushed" to the user 1 and the user location 50 via the Internet 60.

There are many ways of distributing hardware and software functions within a network. The present description is not intended to limit the present subject matter to a particular physical form. Rather, the interactions illustrated define an interactive system in which a number of functions are provided. These functions may be implemented irrespective of whether particular components are located physically within a particular subsystem.

Figure 2:
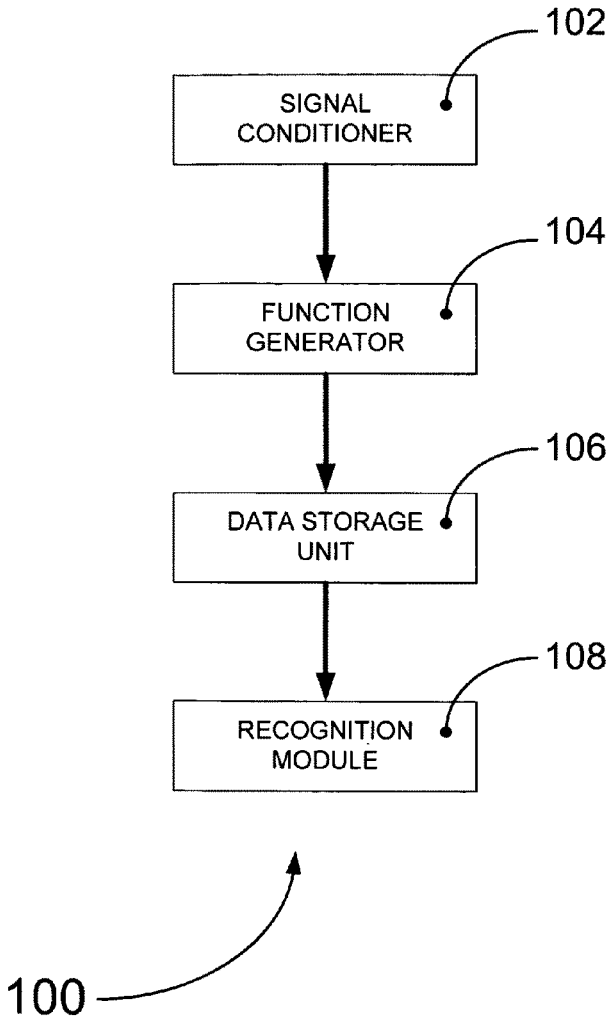
FIG. 2 is a block diagram of a sound processor.

FIG. 2 is a block diagram of a sound processor 100. The sound processor 100 is used to convert sound signals, generally analog signals from a media source, into digital sound patterns. A sound processor 100 may be included in each of the user location 50 and the host server 70. A signal conditioner 102 receives sound and conditions it for provision to a function generator 104. The function generator 104 produces sound patterns, which are provided to a data storage unit 106. Sound patterns represent audio units. Each audio unit comprises one or more of phonemes, words, or concatenated sequences. A phoneme is the smallest phonetic units in a language that can each convey a distinction in meaning. As with a word, a phoneme will have a distinctive output distribution.

Generally, the sounds provided to the user location 50 are from currently playing programs. Generally, the sounds provided to the host server 70 are from previously played programs or other reference sources. However, neither the user location 50 nor the host server 70 is limited to storage of a particular set of sounds.

Many different functions can be used to produce sound patterns. In one embodiment, a hidden Markov model is used to convert sounds into patterns, with each pattern being associated with a particular set of sounds. The hidden Markov model is a function commonly employed in speech recognition. It is used in such commercially available programs as Dragon® Naturally Speaking®.

Hidden Markov models are statistical models which comprise a sequence of symbols or quantities. In speech recognition, a speech signal is resolved into piecewise stationary signals or short-time stationary signals in the range of 10 milliseconds. In this manner, speech is approximated as a stationary process. The stationary signals are suitable for processing using the hidden Markov model.

In the illustrated embodiment, the hidden Markov model provides a sequence of n-dimensional real-valued vectors (with n being a small integer, such as 10). In a nominal application, a vector is provided every 10 milliseconds. The vectors consist of cepstral coefficients, which are obtained by taking a Fourier transform of a short time window of speech and decorrelating the spectrum using a cosine transform, then taking the first (most significant) coefficients. The hidden Markov model will tend to have in each state a statistical distribution that is a mixture of diagonal covariance Gaussians which will give likelihood for each observed vector. Each word will have a different output distribution. By comparing the distribution produced by processing of speech signals to a known distribution, e.g., with a correlation function, words are recognized.

The sound processor 100 may interact with a recognition module 108 (FIG. 2) in order to recognize the sound patterns. There are many techniques known in the art for providing speech recognizers. It is preferable to have a speaker-independent versus a speaker-dependent recognition scheme.

Recognition is carried out by processing a sound pattern, which may be accessed from the data storage unit 106. Preferably, dynamic programming algorithms are used for processing. In this manner, speaker-independent recognition may be provided. Use of a speaker-dependent recognition scheme is not required. Therefore, a training routine for each speaker may be avoided. However, a speaker-dependent recognition scheme could be used if desired.

In one preferred form, the recognition module 108 stores a set of reference templates of audio units. In recent years, there has been a decline in the use of template techniques due to limitations in modeling wide variabilities within a speech signal. However, the template-based technique has been found to be sufficiently rigorous and reliable for use in conjunction with the present subject matter.

Figure 3:
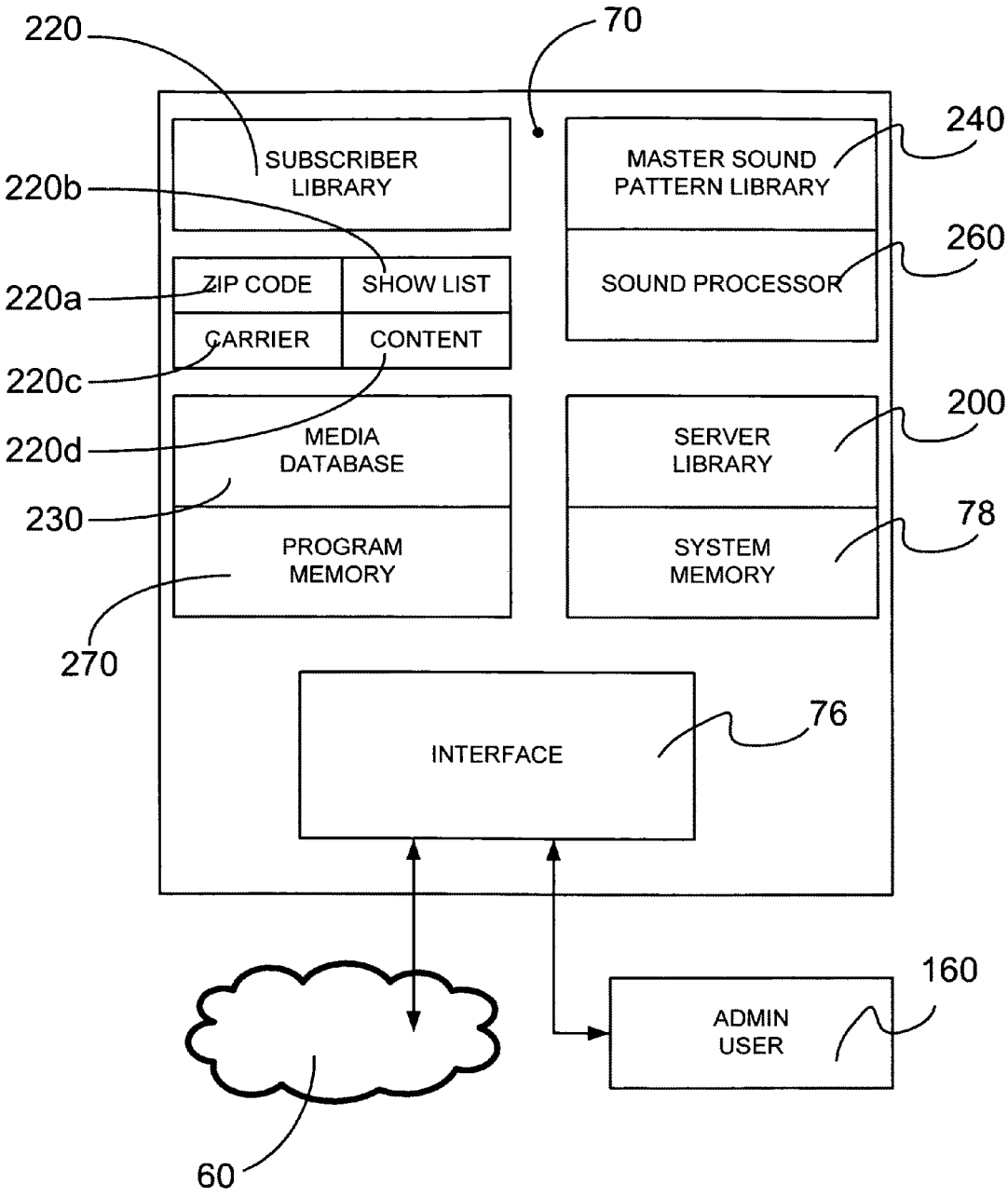
FIG. 3 is a block diagram of a server configured for operation in accordance with the present subject matter.

FIG. 3 is a block diagram of a host server 70 configured for operation in accordance with the present subject matter. For purposes of the present description, host server 70 is described as being operated by an administrative user 160. The administrative user 160 may be human or a machine. A server library 200 comprises a plurality of component libraries, each of which may comprise a database in the system memory 78.

In the present embodiment, a subscriber library 220 is utilized to store information indicative of a user and of content that may be accessed by the user location 50 (FIG. 1). A number of different fields, labeled here as 220 with an alphabetical suffix may be provided. In the present illustration, the following fields are provided: 220*a*—ZIP Code or other postal code; 220*b*—list of television shows to which a selected user location is subscribed; 220*c*—carrier or carriers associated with each television show; 220*d*—available stored media content.

Stored media content may be stored in a media database 230. In one form, stored media content may comprise digital video discs (DVDs). Stored media content may also comprise a video on demand (VOD) system.

The system memory further comprises a master sound pattern library 240. The sound pattern database stores sound patterns which will provide the reference library to which currently sensed sounds may be compared. The sound pattern database may be loaded with sound patterns generated by the sound processor 100 (FIG. 2) external to the system memory 78. Alternatively, the master sound pattern library 240 may include a sound processor 260. The sound processor 260 may take the form of the sound processor 100 described with respect to the FIG. 2 above. A program memory 270 updates lists of schedules and programs which will provide for interactivity. A web crawler search function may be employed to gather appropriate information.

Many forms of interaction of the host server 70 with the user location 50 may be provided. In one preferred form, the user's subscription is parsed. In accordance therewith, the data required by the user for a specific period of time is determined. The interface circuit 76 accesses appropriate information from the system memory 78 and pushes the data to the user computer 54 at user location 50.

Figure 4:
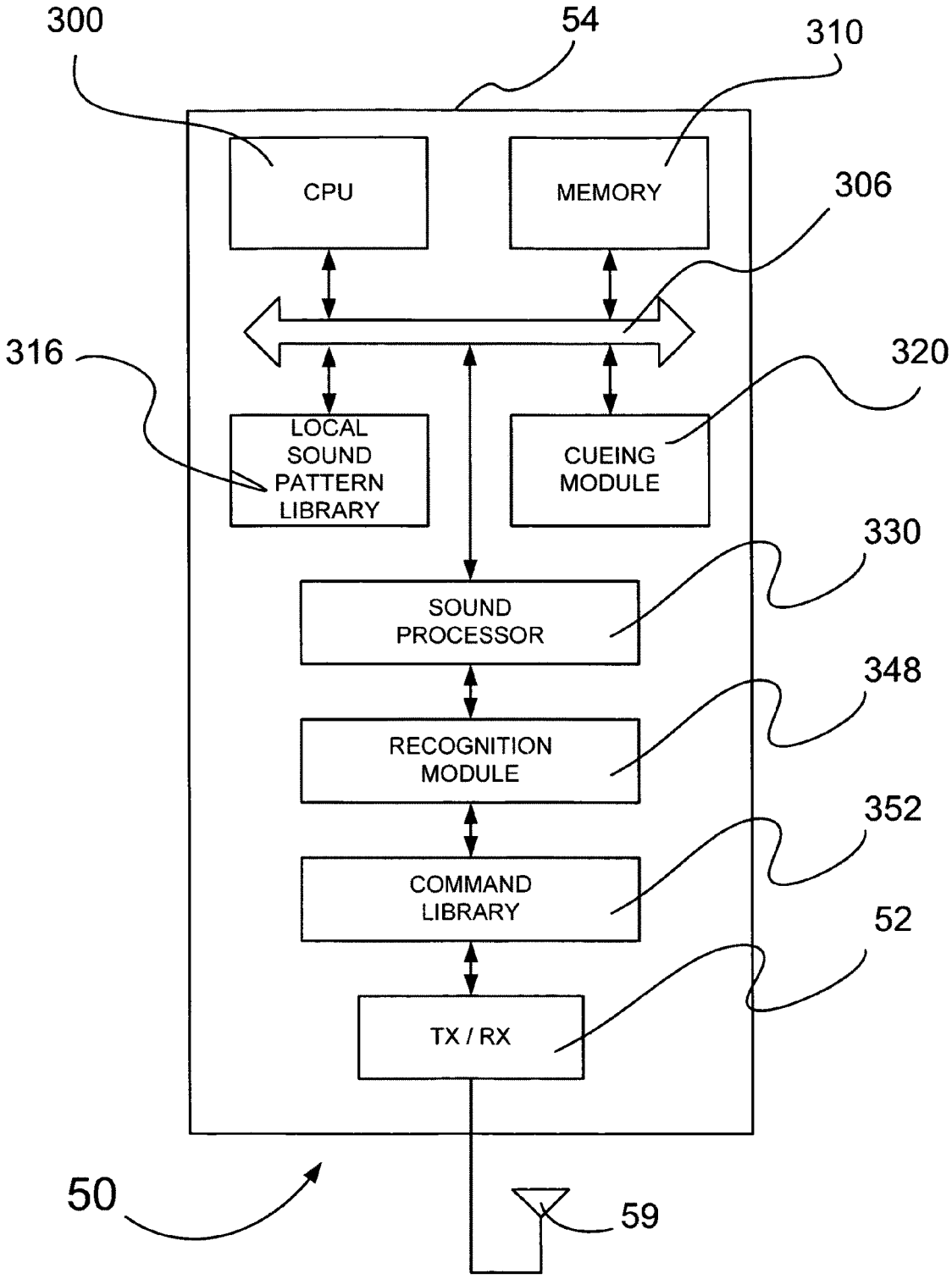
FIG. 4 is a block diagram of a local data processing system interacting with the server and an animated interactive figure.

FIG. 4 is a block diagram illustrating a local data processing system within the user computer 54. FIG. 4 includes the elements described in FIG. 1 and schematically illustrates structure and methods performed in the user computer 54. FIG. 4 is therefore also illustrative of architecture of software employed in the user computer 54, as well as the methods performed by the user computer 54 and the host server 70 (FIGS. 1 and 3).

The user computer 54 comprises a central processing unit (CPU) 300 which interacts through a data bus 306 with a memory 310. Within the memory 310, sound patterns for selected media are stored in a local sound pattern library 316. The local sound pattern library 316 may include libraries for selected programs and selected stored media. The interface 76 (FIG. 3) may include filters to limit media available to the user location 50 to a menu defined by a subscription. The local sound pattern library 316 provides reference signals to which sound patterns based on audio receiving from the media source 10 will be compared.

The content to be accessed from the local sound pattern library 316 is selected by a cueing module 320. The cueing module 320 performs predictive sound pattern cueing. The prediction by the cueing module 320 comprises an inference that a particular program will be provided to the media source 10 at a particular time. In order to be informed of upcoming programs, the cueing module 320 may be loaded with data provided from the host server 70 (FIG. 3) over the Internet 60. The data may comprise information from the program memory 270, as filtered by the information in field 220*b* in accordance with privileges defined by a user's subscription, i.e., a schedule of media to which the user location 50 is subscribed.

The cueing module 320 compares the schedule with a clock signal in order to generate an address. The address accesses the sound library for a particular program from the local sound pattern library 316. If there is only one program matching a clock signal, the cueing module automatically selects the corresponding pattern. If there is more than one possible sound library, cueing pattern may send a signal to the GUI 57 (FIG. 1) accessible to a user at the monitor 56.

The user computer 54 further comprises a sound processor 330 which may be constructed in the same manner as the sound processor 100 of FIG. 2. In the present embodiment, the input to the sound processor 330 represents the analog output of the media source 10. In another form, a digital signal output could be processed. The output of the sound processor 330 is provided to a recognition circuit 348. Selected ones of the sound patterns will correspond to sound patterns in the local sound pattern library 316. The functions selected for use in the recognition circuit 348 is preferably selected to be capable of discriminating background noise. Additionally, the program can be set to detect a match even when the sound pattern provided from the sound processor 330 is incomplete. When the recognition circuit 348 detects a match, an output indicative of the particular recognized sound unit is produced. The output may comprise a digital number or other code. This output addresses a command library 352, which outputs a control signal corresponding to the recognized pattern. Intelligence indicative of the control signal, for example a radiofrequency signal, is transmitted from the user location transceiver 52 to the interactive figure transceiver 36 of the toy 6.

Figure 5:
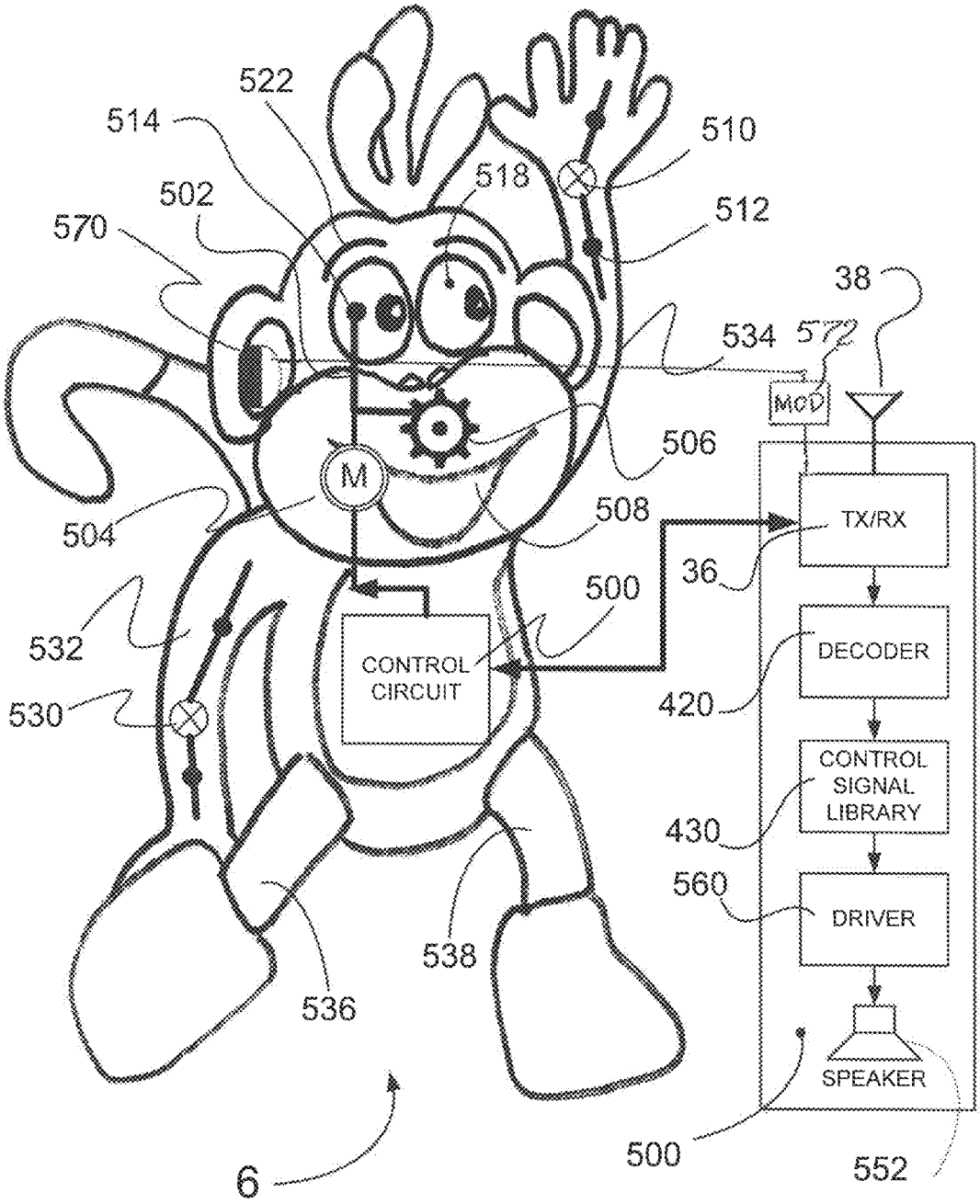
FIG. 5 is a block diagram illustrating an interactive figure.

FIG. 5 is a block diagram of the toy 6. The interactive figure transceiver 36 receives a signal from the user location transceiver 52 (FIG. 4). The interactive figure transceiver 36 is coupled to provide intelligence from the radio frequency signal to a decoder 420. The decoder 420 provides a signal in order to make the toy 6 respond in accordance with preselected actions corresponding to a respective sound pattern. The decoder 420 responds to command signals transmitted from the user location transceiver 52 (FIG. 4). The output of the decoder 420 provides an address to a control signal library 430. The control signal library 430 provides action control signals which are coupled to command motion, for example, to the toy 6.

The toy 6, for example, may be provided with a number of different operable features. In the present illustration the toy 6 has a control circuit 500 receiving the action control signals from the interactive figure transceiver 36. The control circuit 500 is coupled to command the actions of operating components 502. The operating components 502 may include a motor 504 to operate a linkage 506 in order to operate a mouth 508. A second motor 510 may drive a gear assembly 512 to rotate axles 514 to rotate eyes 518 about a vertical axis and to rotate an axle 520 to rotate eyelids 522 about a horizontal axle. Linkage assemblies 530 may also be provided in first and second arms 532 and 534 and in first and second legs 536 and 538.

The toy 6 may also be provided with a loudspeaker 552 to "speak" to the user 1. Audio intelligence may be modulated on the radio frequency link 40 (FIG. 1). However it may be desired to store sounds corresponding to particular actions in the control signal library 430 and transmit information indicative thereof. A driver 560 may be connected between the interactive figure transceiver 36 and the loudspeaker 552.

In one preferred form, a transducer such as a microphone 570 is provided to allow a user to communicate with the user location 50 (FIG. 1). The microphone 570 is coupled to a modulator or digital converter 572 to provide an input to the interactive figure transceiver 36. Inputs from the child 1 (FIG. 1) such as voice input are provided to the user location transceiver 52. The user computer 54 may include a decoder for recognizing inputs from a child 1 and may further comprise a comparator circuit for comparing responses from a child 1 to a question issued by the user computer 54 to preselected information. The user computer 54 may derive intelligence from information from the server 70 or from information stored in the user computer 54 to provide statements to the child 1.

Many other embodiments may be provided in accordance with the present subject matter. Various modifications to these aspects will be readily apparent to those skilled in the art, and the generic principles defined herein may be applied to other aspects without departing from the spirit or scope of the invention. For example, distribution of interactive components may be changed. More specifically, for example, a function depicted as being in the user computer 54 could be performed within a different illustrated box to provide the interaction described in the specification. Other elements can be rearranged and/or combined, or additional elements may be added. Thus, the present invention is not intended to be limited to the aspects shown herein but is to be accorded the widest scope consistent with the principles and novel features disclosed herein.

What is claimed is:

1. A system for operating an interactive figure at a user location in response to a media program comprising: a sound processor at the user location coupled to receive and convert a sound input from a media program source; said sound processor comprising a function generator and a recognition module, said function generator being coupled to receive the sound input and to convert each sound input into a respective sound pattern, each sound pattern being representative of an audio unit; the recognition module being coupled to access a reference library of stored sound patterns in the reference library, and having an output comprising a code corresponding to a stored sound pattern in the reference library which matches the respective sound pattern; a command library coupled to be addressed by the code, said command library providing a command in correspondence with the code for initiating an action in the interactive figure and being coupled for transmission to the interactive figure; and a control circuit located in said interactive figure for receiving commands and commanding action in correspondence with a current command, whereby an action is initiated in correspondence with occurrence of a corresponding audio unit or units in a sound pattern; wherein said audio units are each selected to comprise a phoneme, word, concatenation, or other defined pattern; the system further comprising the interactive figure and wherein said control circuit is located in the interactive figure, the interactive figure further comprising a plurality of operable features, each operable feature being selectively operated in response to a control signal produced in response to the current command; wherein said operable features comprise components corresponding to body parts of an interactive figure, and further comprising a motor and linkages and wherein the control signal operates to connect motive power to at least a selected linkage in correspondence with the current command; and further wherein said reference library of stored sound patterns is located in the interactive figure and wherein said interactive figure comprises a transceiver for receiving signals from a media program source.

2. A system according to claim 1 wherein one said operable feature comprises an audio speaker.

3. A system according to claim 2, further comprising a microphone located in said interactive figure, said microphone coupled to provide an input to the interactive figure transceiver.

* * * * *